US005882128A

United States Patent [19]

Hinojosa

[11] Patent Number: 5,882,128

[45] Date of Patent: Mar. 16, 1999

[54] SELF-ADJUSTING WHEEL FOR DIRECTLY POSITIONING AND HOLDING MEDIA DURING A CUTTING OPERATION IN A PRINTER

[75] Inventor: Antonio Hinojosa, Sant Cugat, Spain

[73] Assignee: Hewlett-Packard Company, Palo Alto, Calif.

[21] Appl. No.: 921,776

[22] Filed: Sep. 2, 1997

[51] Int. Cl.[6] ..... B41J 11/66; B41J 11/70

[52] U.S. Cl. ..... 400/593; 400/621; 183/471.2; 183/483; 183/487

[58] Field of Search ..... 400/593, 621; 101/224, 226, 227; 83/13, 471, 471.2, 472, 56, 486, 487, 485, 488

[56] References Cited

U.S. PATENT DOCUMENTS

| | | | |
|---|---|---|---|
| 3,143,023 | 8/1964 | Addin | 83/472 |
| 4,701,063 | 10/1987 | Wysu et al. | 83/483 |
| 4,979,838 | 12/1990 | Yokota et al. | 400/621 |
| 5,042,349 | 8/1991 | Komatsu | 83/485 |
| 5,066,153 | 11/1991 | Stephens | 400/621 |
| 5,135,318 | 8/1992 | Hongo | 400/621 |
| 5,243,890 | 9/1993 | Ober | 83/471.2 |
| 5,531,530 | 7/1996 | Kuramoto et al. | 400/593 |

*Primary Examiner*—Eugene Eickholt
*Attorney, Agent, or Firm*—David S. Romney

[57] ABSTRACT

A method and device for directly positioning and holding media against an output platen while a cutter traverses across a media path. A cutter assembly is mounted on an arm which periodically passes over the media, and includes a cutter blade and at least one media restraint wheel which presses the media against the output platen. The media restraint wheel is located in close proximity to the cutter blade, such that the media restraint wheel is upstream from the cutter blade and also is laterally displaced from the cutter blade to achieve direct engagement of the media by the media restraint wheel prior to cutting the media. The media restraint wheel includes a soft rubber-like tire which rolls along a top surface of the media while rotating freely on an vertically adjustable axle, in order to accomodate both thick and thin media, without the need for a separate media hold-down device. A biasing spring presses downwardly against the axle to assure secure holding of the media against the output platen. In a preferred embodiment, at least one opposing wheel upstream from the cutter blade is provided on the cutter assembly for rolling engagement with the output platen to assure proper positioning of the cutter assembly.

20 Claims, 14 Drawing Sheets

SELF-ADJUSTING WHEEL FOR DIRECTLY POSITIONING AND HOLDING MEDIA DURING A CUTTING OPERATION IN A PRINTER

RELATED APPLICATIONS

This application is related to copending commonly assigned application Ser. No. 08/646,693, now issued as a U.S. Patent filed in the name of Joaquim Brugue, et al, entitled MEDIA CONTROL TECHNIQUE FOR CUTTING OPERATION ON A PRINTER, now issued as a U.S. Patent which is incorporated herein by reference.

BACKGROUND OF THE INVENTION

Printers often provide a cutter which can be used to cut the media without having to remove the media from the printer. This is particularly desirable in large format printers which typically have rollfeed media. Conventional cutters have been mounted on large format printers for either automated or manual actuation to pass a cutting blade across the media after a printing operation is completed. Some rotary cutting blades have been used in conjunction with fixed linear blades on the printer, and various techniques have been used to hold tie media in position during a cutting operation. However, such prior cutters have either been overly expensive and complicated, or have not provided precise and reliable cuting of the media.

Accordingly there is a need for a simplified cutter that provides automated cutting using a self-contained cutter assembly which employs rotary blades and rotating wheels to traverse across printed media while providing a satisfactory cutting operation.

BRIEF SUMMARY OF THE INVENTION

A method and device for directly positioning and holding media against an output platen while a cutter traverses across a media path. A cutter assembly is mounted on an arm which periodically passes over the media, and includes a cutter blade and at least one media restraint wheel which presses the media against the output platen. The media restraint wheel is located in close proximity to the cutter blades such that the media restraint wheel is upstream from the cutter blade and also is laterally displaced from the cutter blade to achieve engagement of the media by the media restraint wheel prior to cutting the media. The media restraint wheel includes a soft rubber-like tire which rolls along a top surface of the media while rotating freely on an axle slidably mounted in two spaced apart vertical slots. This provides vertical adjustability in order to accomodate both thick and thin media as well as changes in the platen itself, without the need for a separate media hold-down device. A biasing spring presses downwardly against the axle to assure secure holding of the media against the output platen as well as to assure proper vertical positioning of the cutter assembly. In a preferred embodiment, at least one opposing wheel upstream from the cutter blade is provided on the cutter assembly for rolling engagement with the output platen to properly position the cutter.

FIG. 1 fragmented pictorial view showing a printer which incorporates the present invention with an active deflector guide;

Figure 1:
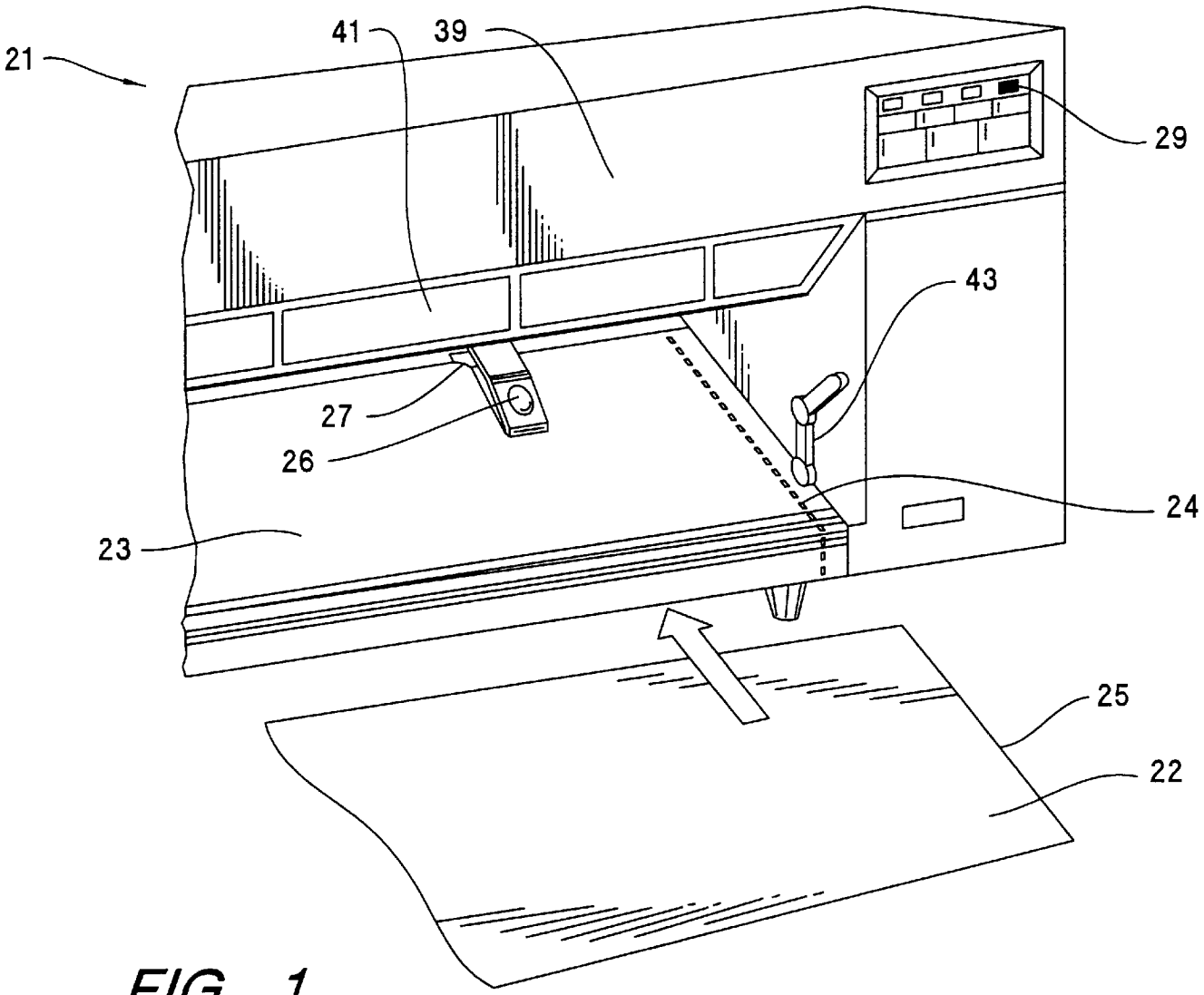

Referring now to FIGS. 1–4 in the drawings, the invention is applicable to a printer such as a large format inkjet printer 21 into which printing media such as sheet 22 may be fed along a media path leading to a print zone (not shown). A front input platen 23 for the printing media has on one side an alignment of reference marks 24 which may be formed by small holes, for enabling a corresponding side edge 25 of the printing media to be aligned at the moment when it is introduced into the font portion of the printer The manual feeding operation for loading the printing media into the machine therefore involves the alignment of the edge 25 with the reference line (See FIG. 2). As part of the media feeding procedures, the operator must ensure that a front leading edge of the printing media is suitably positioned without substantial deviation. This entire operation takes place with the printing-media entrainment rollers (typically a pick-roller and opposing pinch rollers) stationary to allow the operator to manipulate the printing media properly as it enters the machine. Only when the operator has ensured that the printing media is suitably positioned at the input of the machine does he operate a control button for activating the drive motor of the printing media entrainment rollers. In the embodiment shown in the drawings, a push-button 26 is incorporated in an active deflector guide 27 which acts as a deflector for both the input and output of the printing media. This arrangement considerably facilitates the manual operation of the activation push-button. However, the push-button may be disposed in any other position on the machine, for example, on the instrument panel 29 or in another suitable place, as appropriate for the general configuration of the machine or for the way in which it operates.

Figure 2:
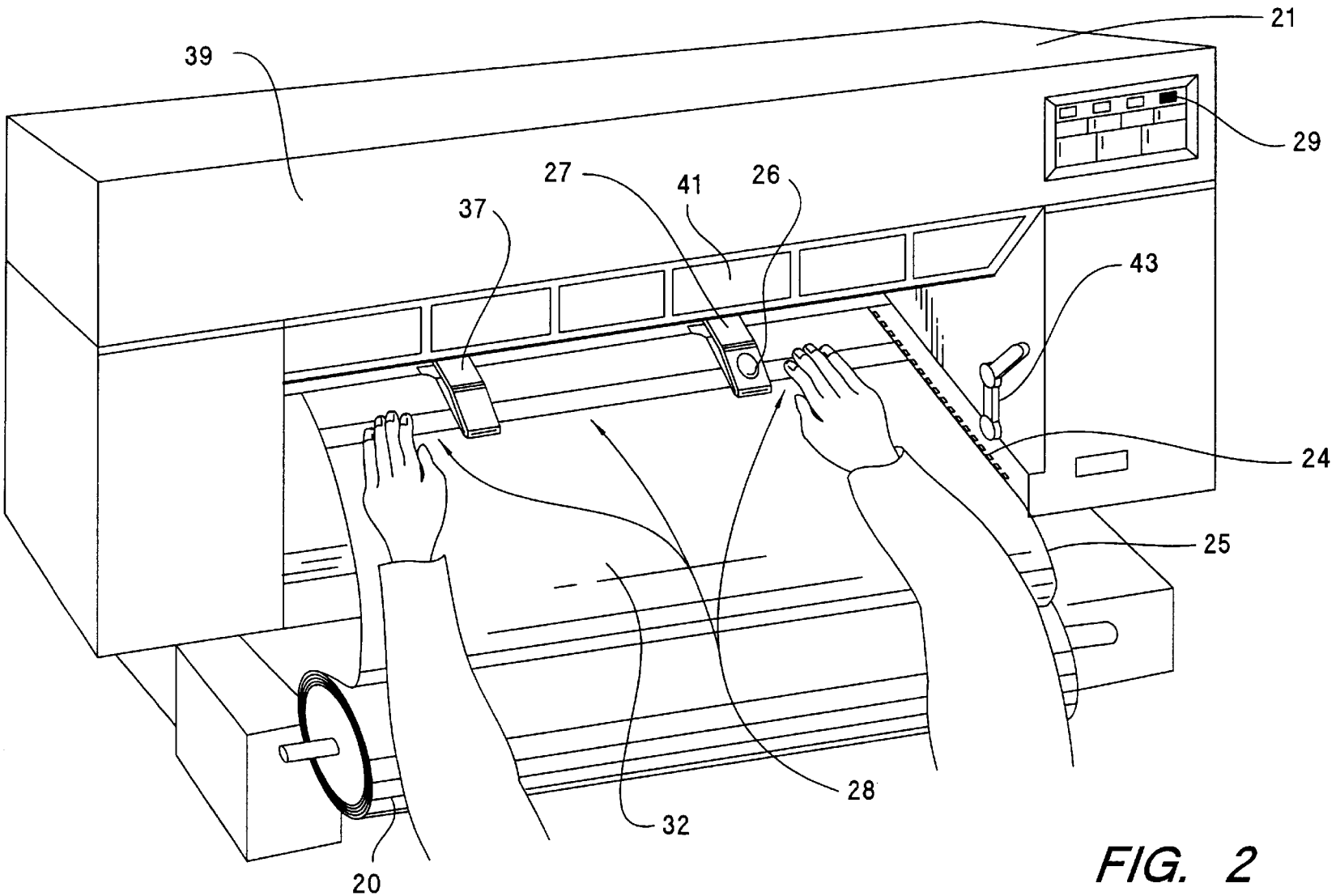
FIG. 2 shows a front pictorial view of a rollfeed printer which incorporates the present invention with a user manually feeding a leading edge of rollfeed media past two deflector guides.
Figure 3:
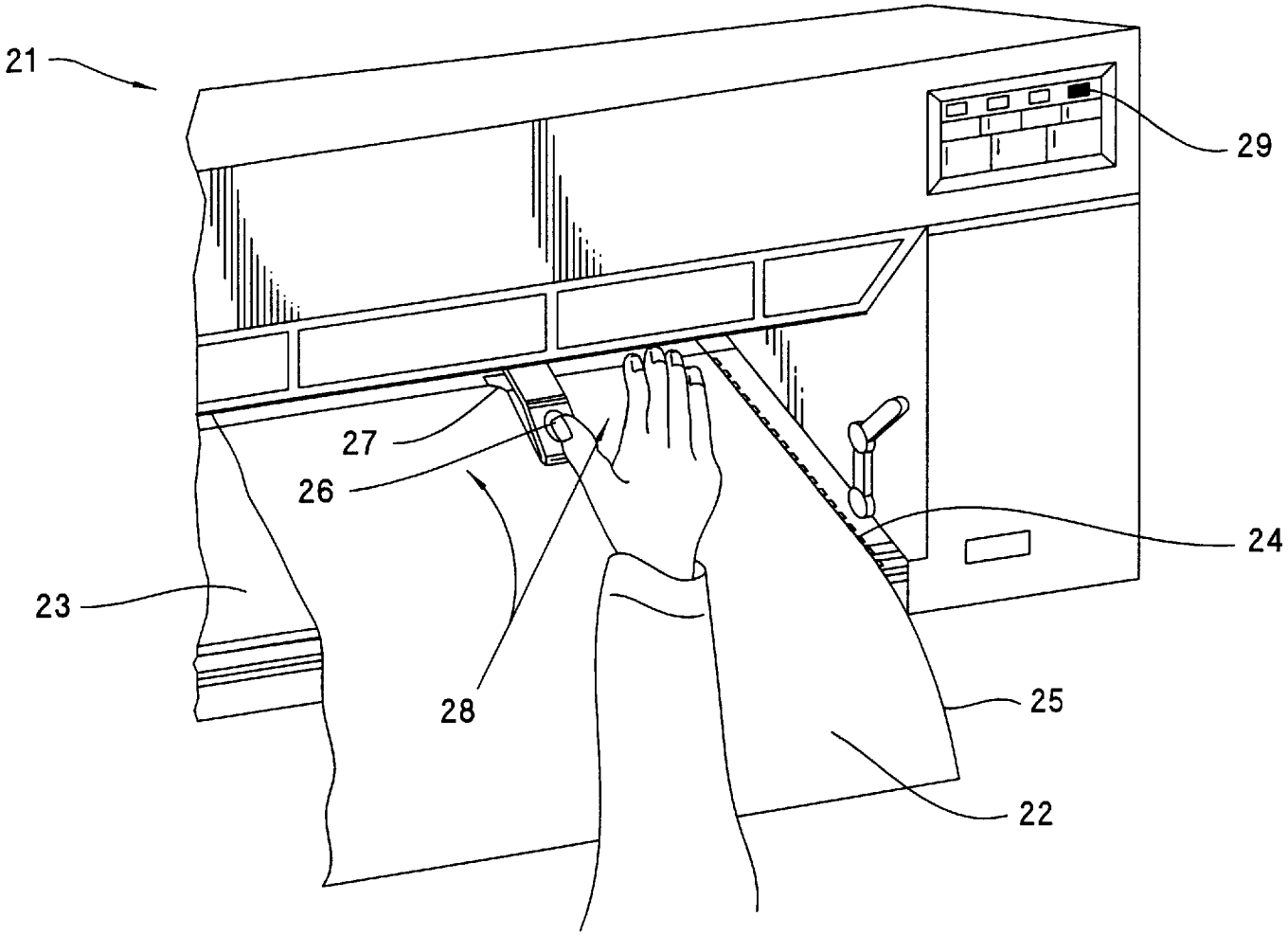
FIG. 3 shows the pictorial view of FIG. 1 with a leading edge of media in position for being pulled into a media path, upon activation of a control button on an active deflector guide by a user without having to remove the right hand from holding the media against an input platen.
Figure 4:
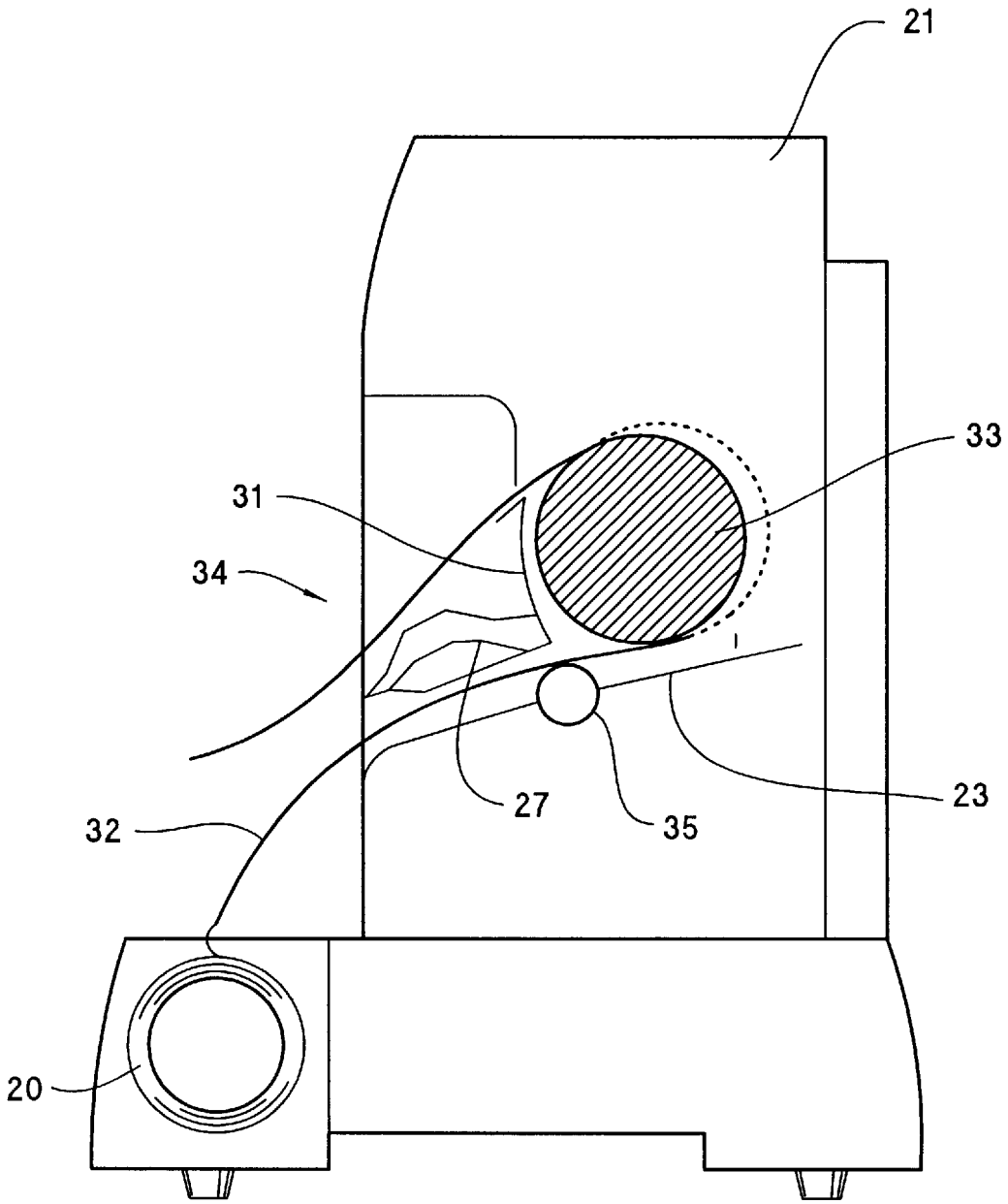
FIG. 4 is a schematic view partially in cross-section showing a media path for passing rollfeed media through the printer of FIGS. 1–3.
Figure 5:
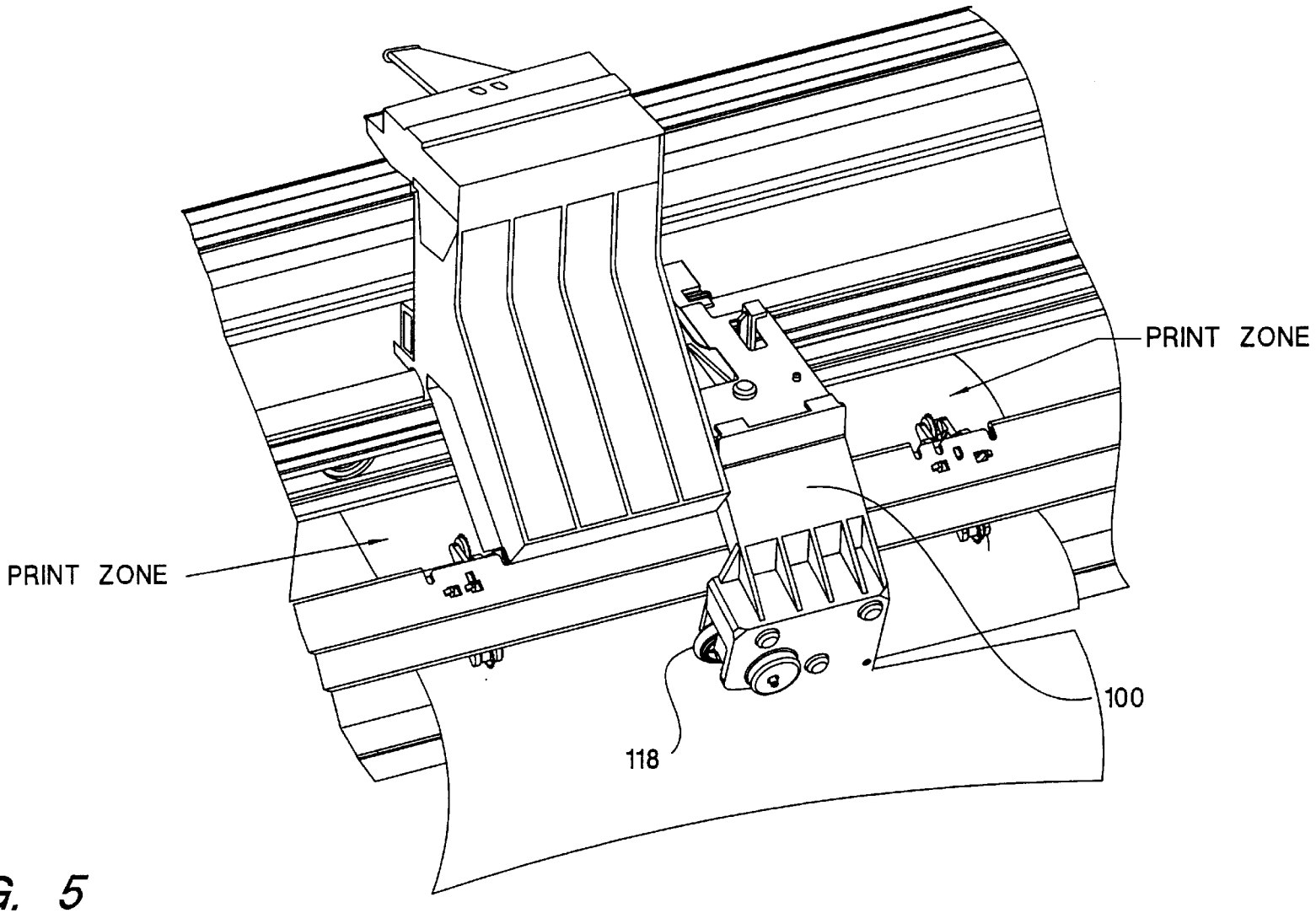
FIG. 5 is a fragmented perspective view showing a second embodiment of a cutter assembly which has been moved by a motorized printer carriage from right to left to cut off a section of media which has passed through a print zone of the printer.
Figure 8:
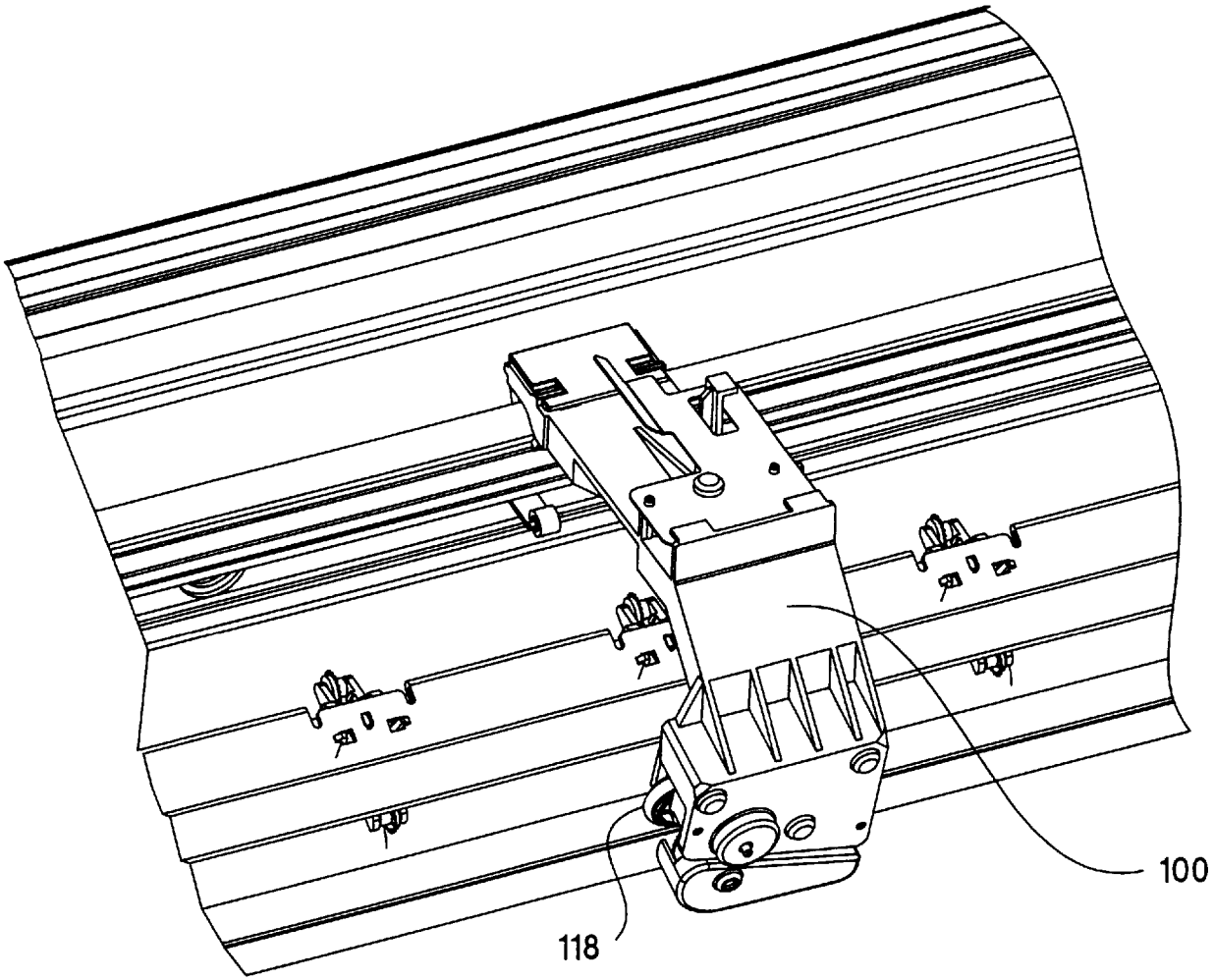
FIG. 8 is an enlarged fragmented perspective view showing the second embodiment of the cutter assembly of FIG. 5 slidably mounted on a carriage support rod.
Figure 9:
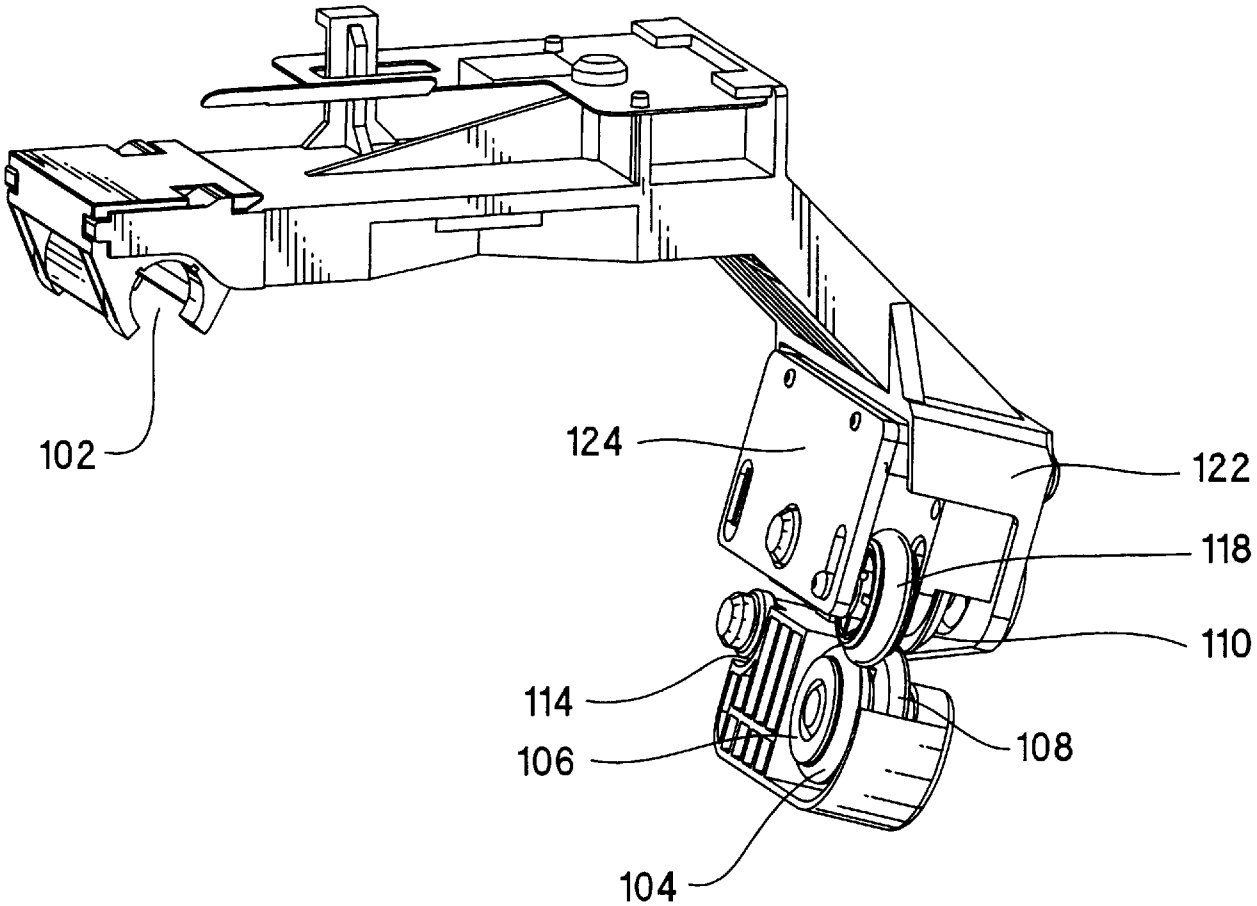
FIG. 9 is a perspective view of the cutter assembly of FIG. 5.
Figure 10:
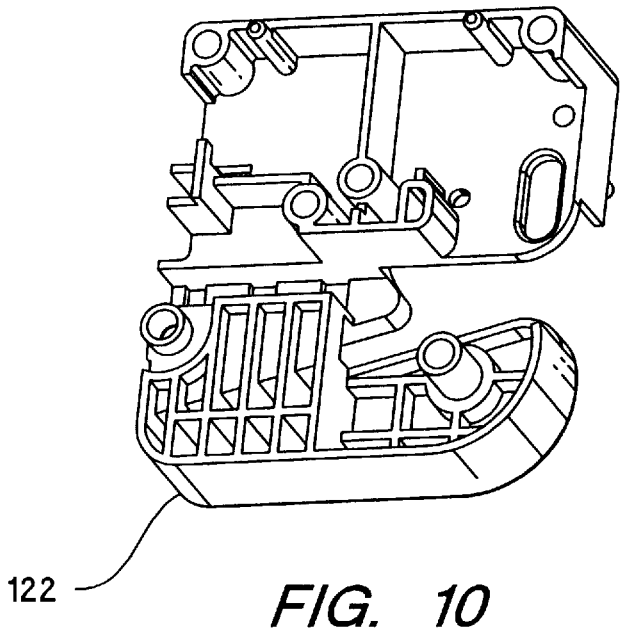
FIG. 10 is an enlarged internal view of a cutter housing without any wheels or cutting blades.
Figure 11:
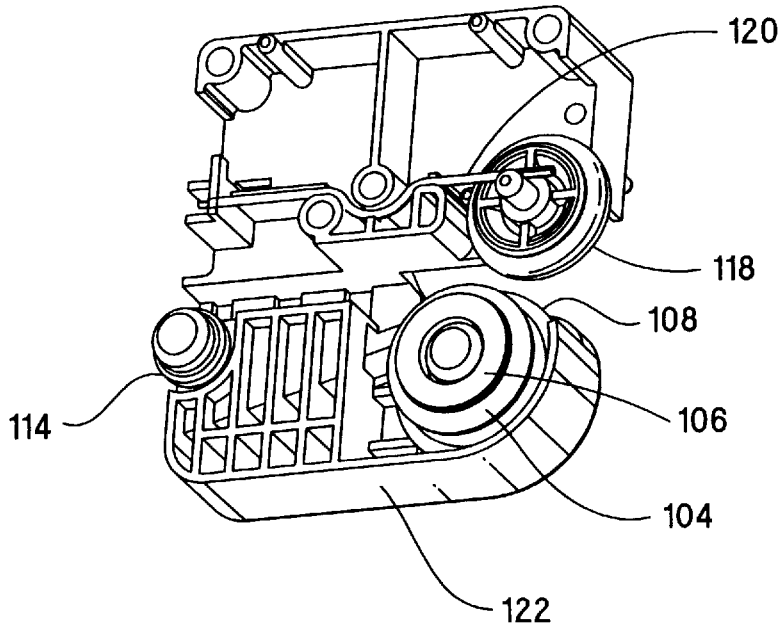
FIG. 11 shows the internal view of the cutter housing of FIG. 1O with one rotary cutting blade, three wheels and a downward biasing spring mounted therein.
Figure 12:
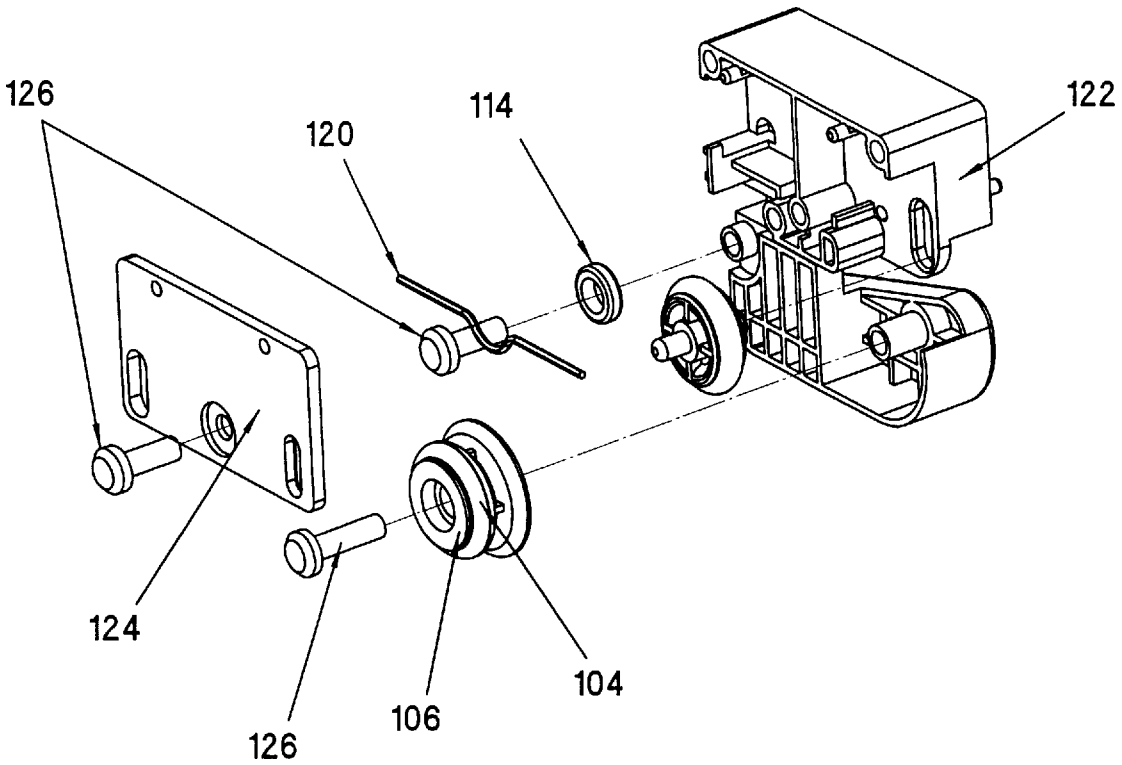
FIG. 12 shows an exploded view of FIG. 11 with a head cover and mounting screws included.
Figure 13:
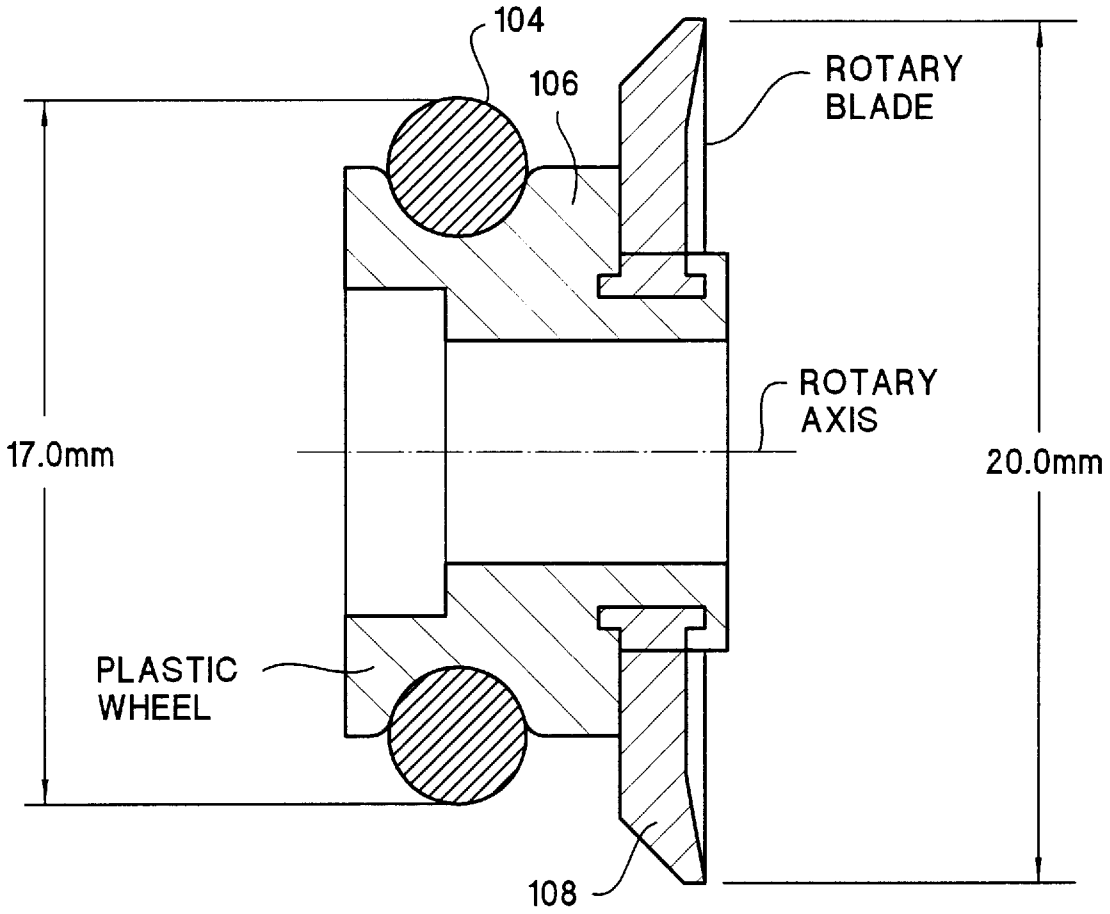
FIG. 13 is a partial sectional View of a combined drive wheel/rotary cutter.
Figure 14:
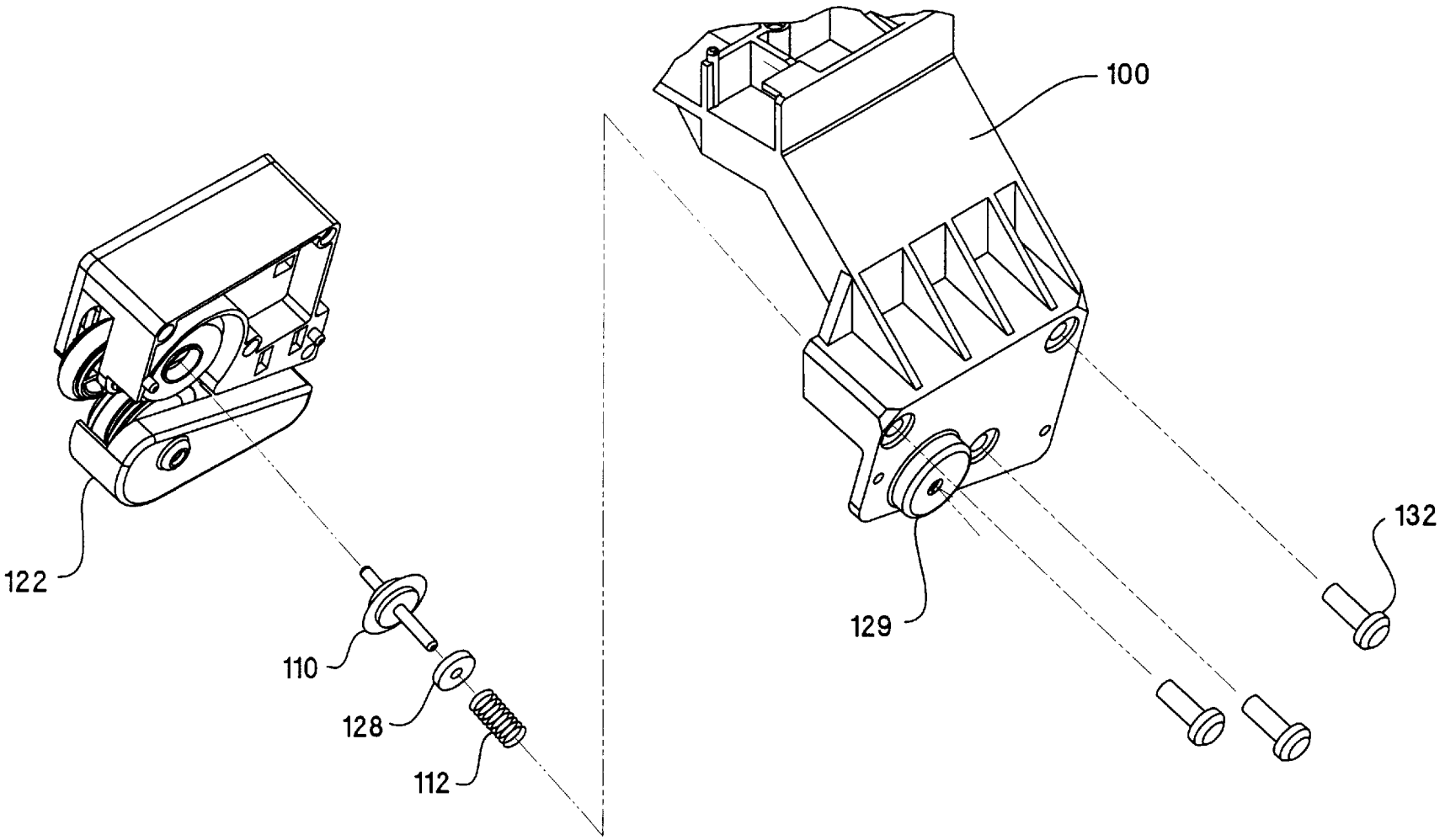
FIG. 14 is an exploded view showing how the components of FIG. 12 are attached with a second rotary cutter to one end of a cutter arm.

As can be seen from FIGS. 2 and 4, the rollfeed printing media 32 can proceed from a roll 20 past a deflector guide 27 and media shield 31 along an input platen 23 to an entry slot between a main roller 33 and pinch wheel 35 for passing the media past a print zone (not shown) to an output path 34. The space 28 between or adjacent to the deflector guides (active 27 and passive 37) is available for placing one or both hands directly on top of the media to guide its leading edge up to the input slot. Even when the printer top 39 is closed, it is still possible see the media through a transparent window 41 on the front of the printer top. Also, one of the manual access spaces 28 on the right side of the input platen is very close to a pinch wheel release lever 43 for moving the pinch wheels between an engagement and disengagement position. FIGS. 5, 8 and 9 show the details of the fully operating cutter assembly which is retrieved from a parking position by the carriage in a manner previously implemented in the previous DesignJet large format printers.

Figure 7:
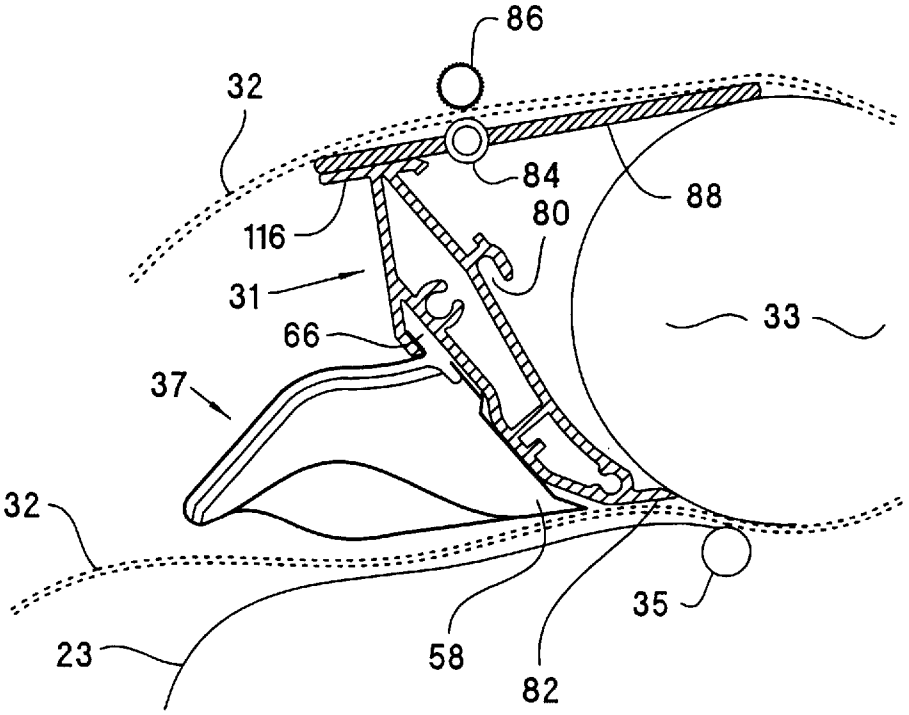
FIG. 7 is partial sectional view showing the guide platen of FIG. 6 integrated with the input and out paths for media passing through the printer.
Figure 6:
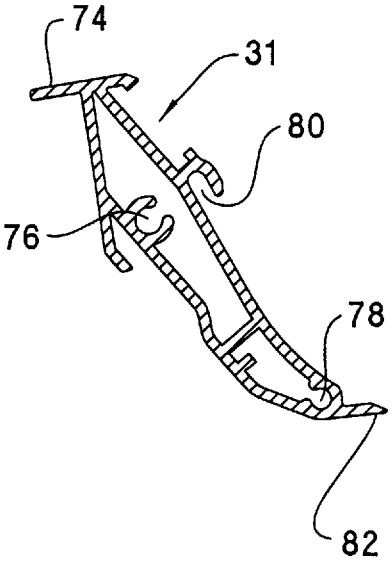
FIG. 6 is a right end view of a guide platen for the cutter assembly as shown in FIG. 5.

FIGS. 6–7 show the details of the media shield 31, including an output platen 74, central and bottom mounting screw holes 76, 78, rear mounting slot 80 for hanging on right and left printer frame pins (not shown), and input slot guide 82 which aligns with rear edge 58 to provide a continuous guide into the pinch wheels/pick roller portion of the media path. The output path may include output rollers 84, star wheels 86, and a flexible mylar paper separator 88.

FIGS. 10–14 show the details of the mounting of cutter blades and wheels within the casing and housing components of the cutter assembly.

Figure 15A:
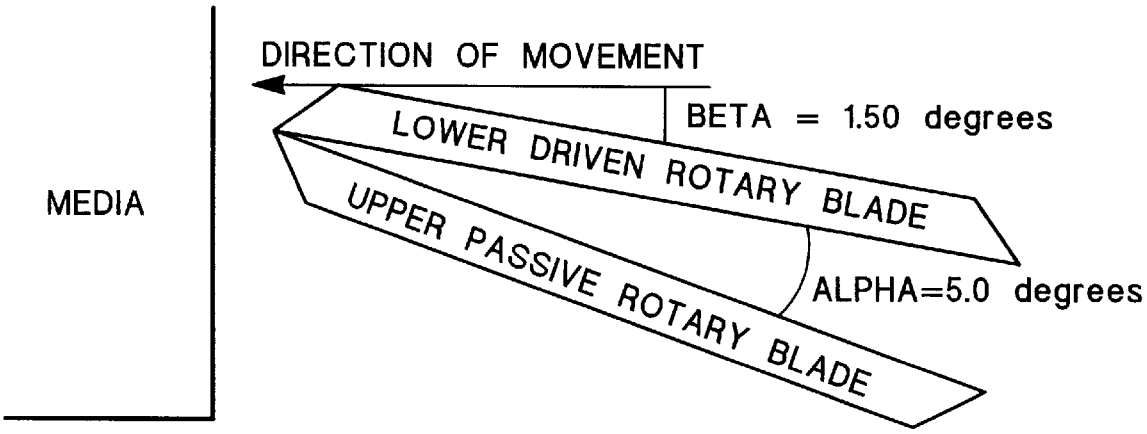
FIG. 15A Is a schematic diagram showing preferred angles of inclination for two rotary cutting blades.
Figure 15B:
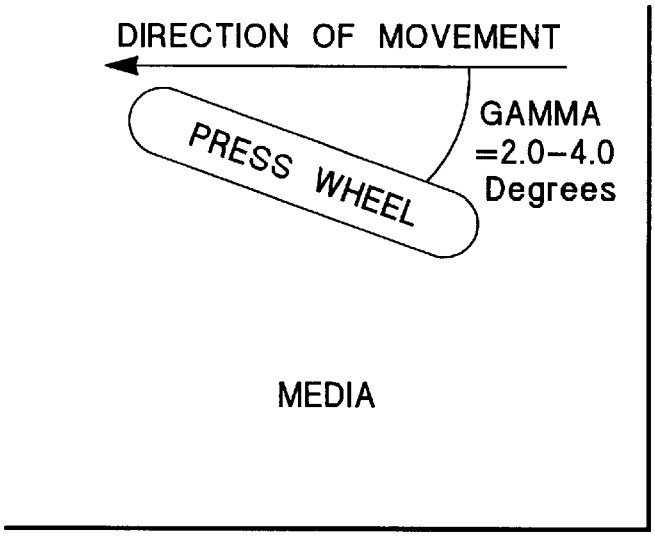
FIG. 15B is a schematic diagram showing a preferred range of angles of inclination for media press wheel.

FIGS. 15A and 15B show the specific angular declinations of the cutter blades and wheels. In that regard, the amount of overlap between the two rotary cutter blades determines the angle of deflection of the cut media passing from the cutter assembly, which in the preferred embodiment is approximately 13 degrees.

Figure 16:
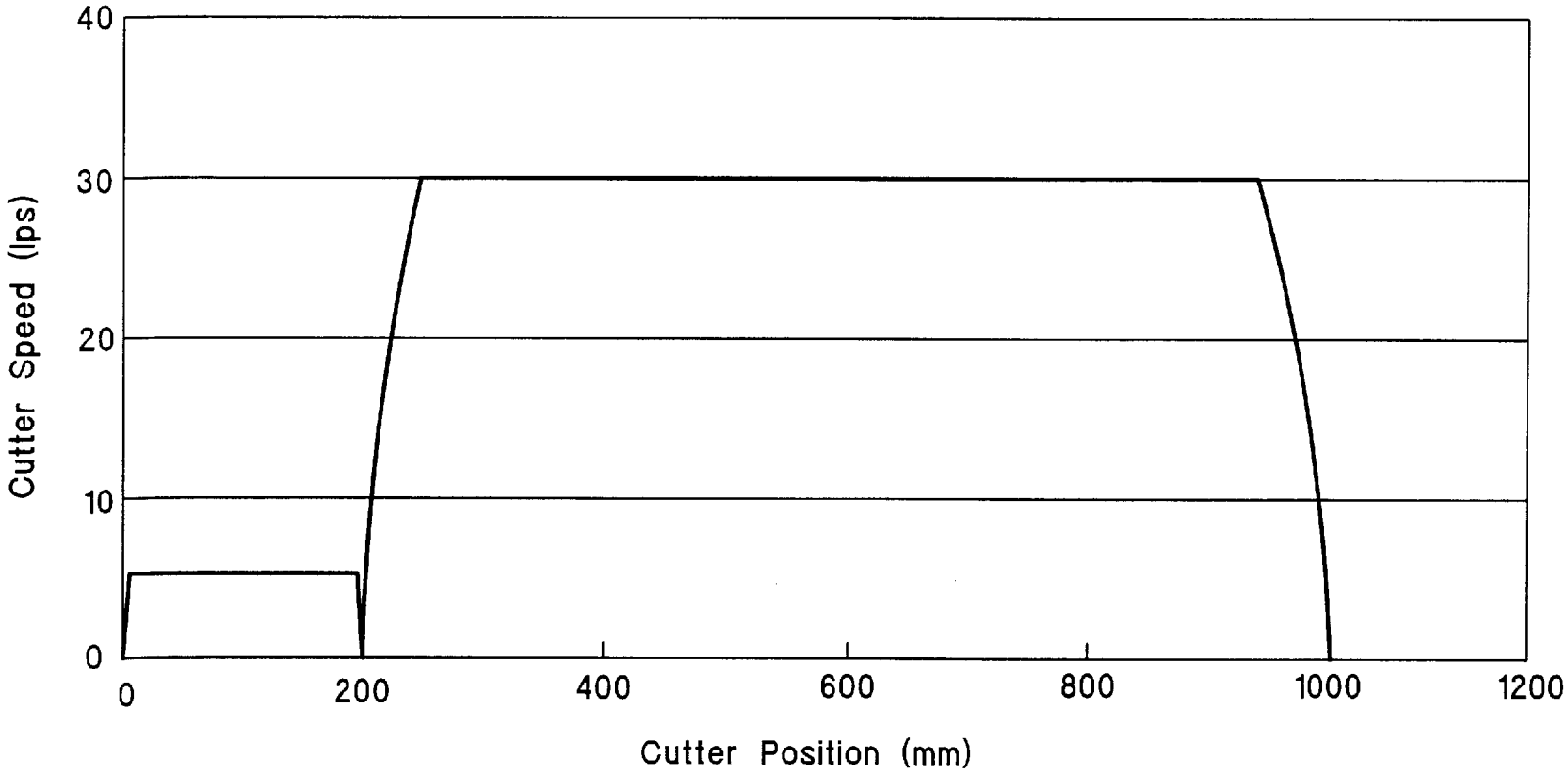
FIG. 16 a graph showing preferred traversing speeds for the cutter assembly during a cutting operation.

FIG. 16 shows that a preferred initial translational speed of the cutter assembly at the time of first encountering the media to be cut is 5 ips, while thereafter the preferred speed through the rest of the cutting operation is 3 ips.

It will be understood from the drawings that the cutter arm 100 rides on the same slider bar as the carriage through bushing 102, and carries cutter components lower driven tire 104 having a central wheel 106 and concentric driven rotary blade 108, as well as upper rotary blade 110 which is biased by spring 112 against the driven blade. An additional positional tire 114 is provided which is periodically engaged by the underside 116 of the output platen which is textured to assure maintenance of the proper frictional contact with the drive tire. The upper tire 118 is biased by sprig 120 which is mounted along with the other aforesaid components in housing 122. A side plate 124 and related mounting screws 126 provide attachment and bearing functions for the various components. An additional biasing spring 128 acts against the second rotary blade 130 by virtue of additional mounting screws 132.

It will therefore be appreciated by those skilled in the art that a compact yet sophisticated cutter assembly is provided for manual or preferably automated cutting of media in a printer, all as set forth in the following claims.

We claim as our invention:

1. A printer for cutting through media in a cutting zone located downstream from a printing zone, comprising:

a printer frame having an output platen located in a cutting zone downstream from a printing zone;

a cutter assembly mounted for movement across said cutting zone, and carrying at least one cutting element; and a media restraint wheel on said cutter assembly and laterally displaced from said cutting element to achieve engagement of the media by the restraint wheel to press the media against said output platen prior to cutting the media by said at least one cutting element.

2. The printer of claim 1 wherein said restraint wheel includes a soft rubber-like tire for direct rotating contact with the media.

3. The printer of claim 1 wherein said media restraint wheel applies pressure to hold the media against a top surface of said output platen, and further including an opposing wheel on said cutter assembly which engages a bottom surface of said output platen.

4. The printer of claim 3 wherein said restraint wheel and said opposing wheel are located approximately the same distance downstream from said printing zone.

5. The printer of claim 2 wherein said restraint wheel includes a central portion of a first material, and wherein said rubber-like tire is made of a material that is different from said first material.

6. The printer of claim 2 wherein said rubber-like tire is separately mountable on said restraint wheel.

7. The printer of claim 1 wherein said at least one cutting element includes two rotary cutting blades.

8. The printer of claim 7 wherein said two rotary cutting blades are mounted on said cutter assembly a fixed distance apart from each other.

9. The printer of claim 8 wherein said two rotary cutting blades are spaced apart such that their peripheral cutting edges overlap a predetermined distance.

10. The printer of claim 7 wherein said two rotary cutting blades cut the media without using any additional cutting elements on the printer.

11. The printer of claim 1 wherein said media restraint wheel is slidably mounted for vertical adjustability depending on the thickness of the media.

12. The printer of claim 11 wherein said cutter assembly further includes spring means for biasing said restraint wheel downwardly against the media.

13. A printer for cutting through rollfeed media in a printer, comprising:

a printer frame having a platen for supporting media passing along a media path;

a cutter assembly mounted for movement across the media path;

one or more cutter elements carried on said cutter assembly, eliminating the need for any other cutter elements on the printer; and a media restraint wheel on said cutter assembly and laterally displaced from said one or more cutter elements to assure direct contact by said restraint wheel against the media to hold the media against the platen prior to cutting the media by said one or more cutter elements.

14. The printer of claim 13 wherein said one or more cutter elements include a first rotary cutter located generally above the media and a second rotary cutter located generally below the media.

15. The printer of claim 14 wherein said first and second rotary cutters have a diameter of less than 3 cm.

16. The printer of claim 13 wherein said restraint wheel has a diameter of less than 2 cm.

17. The printer of claim 13 wherein said restraint wheel includes a rubber-like tire for direct engagement with a top printable surface of the media.

18. A method of cutting rollfeed media in a printers comprising the steps of:

passing the media through a print zone in a forward direction along a media path to create printed media;

maintaining the printed media in a stationary position in a cutting zone located downstream from the print zone;

rolling a tire across a surface of the printed media to hold the printed media against an output platen in the printer; and passing a rotary cutting blade along a cutting line on the media to cut a section of printed media.

19. The method of claim 18 wherein said rolling step is applied to a surface of the printed media upstream from the cutting line of said passing step.

20. The method of claim 18 wherein said passing step includes passing a pair of rotary cutting blades along said cutting line by operation of an automated component of the printer.

* * * * *